United States Patent [19]

Sato

[11] 4,285,275

[45] Aug. 25, 1981

[54] PRINTING PLATEN FOR HAND LABELER, OR THE LIKE

[75] Inventor: Yo Sato, Tokyo, Japan

[73] Assignee: Kabushiki Kaisha Sato Kenkyusho, Japan

[21] Appl. No.: 51,954

[22] Filed: Jun. 25, 1979

[30] Foreign Application Priority Data

Jun. 26, 1978 [JP] Japan ..... 53-86641[U]

[51] Int. Cl.[3] ..... B41K 1/36; B41F 1/38

[52] U.S. Cl. ..... 101/407 BP; 101/288; 400/662; 226/196

[58] Field of Search ..... 101/288, 291, 292, 407 BP, 101/407 A, 407 R; 400/662, 648, 661.3, 661.4; 226/196

[56] References Cited

U.S. PATENT DOCUMENTS

| | | | |
|---|---|---|---|
| 705,294 | 7/1902 | Rhodes | 101/407 R |
| 1,140,511 | 5/1915 | Gauthier | 101/407 R |
| 1,555,104 | 9/1925 | Corcoran | 400/662 |
| 3,107,830 | 10/1963 | Van't Veld | 226/196 |
| 3,480,127 | 11/1969 | Hesse et al. | 400/662 |
| 3,843,035 | 10/1974 | Fitterer et al. | 226/196 |
| 3,868,008 | 2/1975 | Brumbaugh | 400/662 |
| 4,104,106 | 8/1978 | Hamisch, Jr. | 101/292 |
| 4,176,603 | 12/1979 | Sato | 101/288 |

*Primary Examiner*—William Pieprz

*Attorney, Agent, or Firm*—Ostrolenk, Faber, Gerb & Soffen

[57] ABSTRACT

The disclosure concerns a printing platen for use with a hand labeler, or the like. The platen assures there will be clear imprint by the types of the printing head, with all characters having an averaged density, even if there are discrepancies in the heights and orientations among the type surfaces of the printing head of the hand labeler. The platen includes an impression plate formed from an elastic member having a rough surface, onto which a continuous strip of labels is fed and against which the type surfaces are contacted through the label strip. The impression plate roughness may comprise multiple parallel corrugations or an array of a large number of projections, e.g. a checkerboard array. These projections may have any of square, pyramid, hexagonal and semi-spherical cross-sectional shapes.

5 Claims, 7 Drawing Figures

PRINTING PLATEN FOR HAND LABELER, OR THE LIKE

BACKGROUND OF THE INVENTION

1. Field of the Invention

The present invention relates to a portable labeling machine, or the like, and more particularly to a printing platen for use with the portable labeling machine, or the like which platen enables labels, or the like, to be imprinted clearly with averaged imprint uniformity and density.

2. Description of the Prior Art

The printing platen of a portable labeling machine (which will be referred to as a "hand labeler") or of a tagging machine is located so that labels or tags placed thereon may be imprinted with the indicia of a plurality of types which are carried on type wheels or type bands or other type carriers of a printing head. The types are often arrayed in a row across the printing head, and a number of rows of types may be provided along the length dimension of the platen.

Generally, the printing platen is made of hard, i.e. non-deformable in normal use, material, such as a metal plate or a hard plastic.

The printing types for a hand labeler are usually made of an elastic material, such as rubber. As a result, even if the printing surfaces of the respective rows of the types of a printing head (or of the type wheels or bands of the printing head) become irregular or rough or have different heights due to errors during production or due to wear after use, the raised elastic types are depressed when they are brought into contact with the surface of the label upon the printing platen during the printing operation. The types as a whole are flattened when they contact the label surface, so that a clear imprint, having an averaged imprint density, can be effected as a whole.

Types made of relatively hard plastics have recently been frequently used for a hand labeler because of the ease of their production, the reduction in their production cost and their excellent durability, in comparison with the conventional types made of rubber. Sometimes types made from metal are used, for most of the same reasons as hard plastic types are used. In case the types are made of a hard plastic or of metal, the raised types will not be depressed during the printing operation because the material from which the types are made has lower elasticity, as compared with softer plastic. If there are discrepancies in height among the types in a row or among the plurality of rows of types, the more depressed types will fail to contact the label surface or will have a relatively slight contact pressure, so that the imprints corresponding to the depressed types will either not be obtained at all or will be unclear, thus making it difficult to effect a clear imprint as a whole.

Thinness, faintness and uneven density imprints are acceptable to some extent in case the imprints are read by the human eye. But, this can be a fatal defect in the case of a POS (Point-Of-Sales) system, in which the imprint has to be read by an optical character reader requiring clear and highly accurate imprints.

SUMMARY OF THE INVENTION

It is therefore an object of the present invention to enable clear, more uniform density imprints to be imprinted on a label, or the like, by a hand labeler, or the like.

It is another object of the invention to attain the previous object even using relatively hard types for imprinting.

It is a further object of the invention to provide a printing platen for use with a hand labeler, or the like, which enables such imprints to be obtained.

Another object of the present invention is to provide a printing platen of the above type, which enables a clear imprint having averaged density to be effected, even if there are discrepancies in height or orientations among the type surfaces of a printing head.

According to the present invention, a printing platen for use with a hand labeler is provided. The hand labeler includes a frame and a hand lever pivotally attached to the frame. A printing head having a plurality of printing types on it is supported by the frame. The types are opposed to the platen. Operating means connect the hand lever to at least one of the printing platen and the printing head, whereby they may be moved together to imprint a label and may be moved apart.

The platen has an impression plate comprising an elastic member with a rough surface. The surface roughness may be obtained from corrugating the surface or from defining a large number of preferably closely spaced, relatively small cross-section projections in the impression plate. A continuous strip of labels, or the like items to be imprinted, is fed onto the rough surface. The surfaces of the types of the printing head are brought into contact with the rough surface of the platen through the label strip so that the indicia on the types of the printing head may be imprinted upon the labels with a uniform imprint density.

BRIEF DESCRIPTION OF THE DRAWINGS

Other objects and features of the present invention will become apparent from the following description taken in conjunction with the accompanying drawings, in which.

DESCRIPTION OF THE PREFERRED EMBODIMENTS

Figure 1:
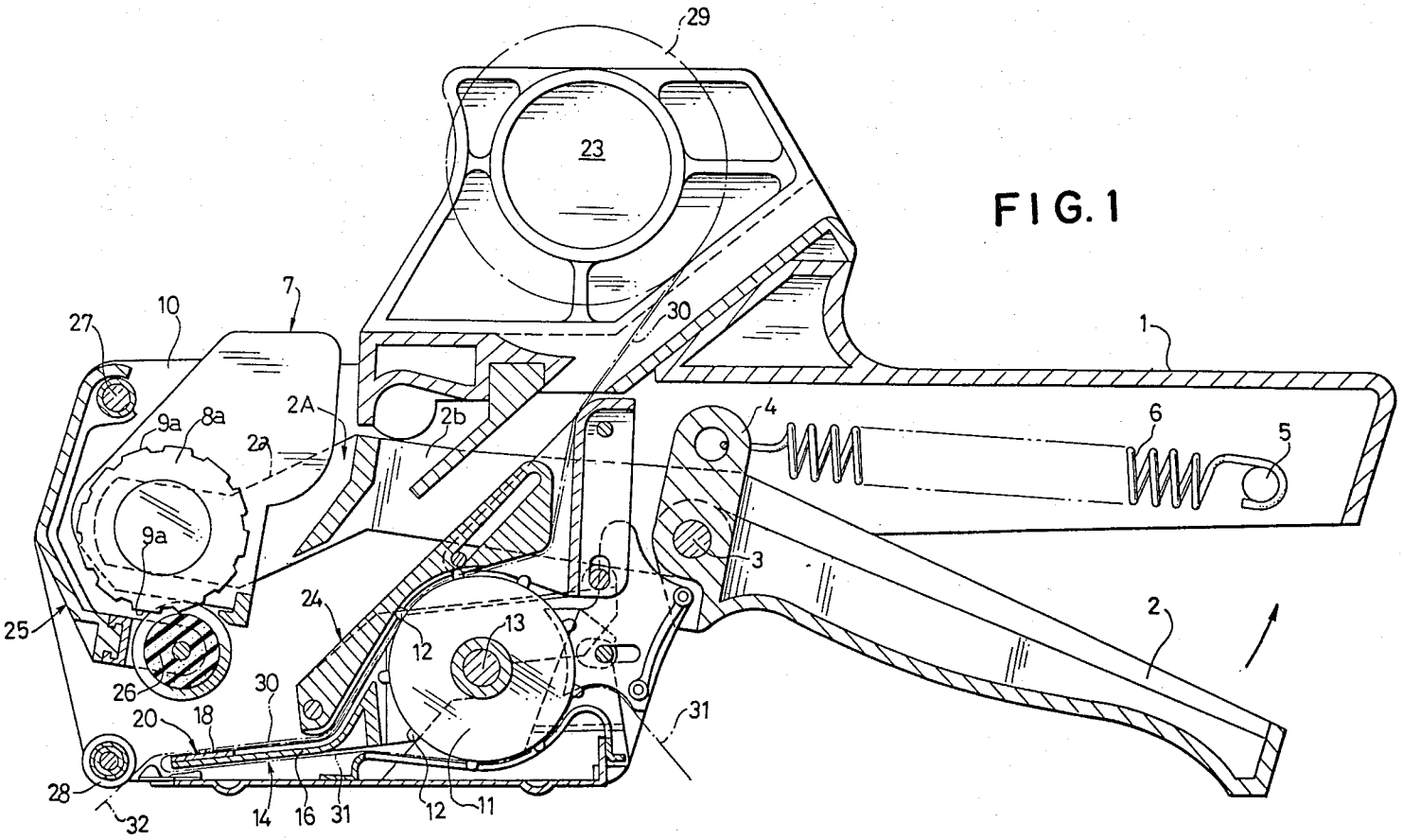
FIG. 1 is a sectional side elevational view showing a portable labeling machine or a hand labeler which is equipped with a printing platen according to the present invention.

FIG. 1 shows a hand labeler, which is equipped with a printing platen according to the present invention. A hand grip 1 is integrally formed with the frames 10 of the hand labeler, such that it extends backwardly (or to the right in FIG. 1) from the hand labeler frames. A hand lever 2 is located below the hand grip 1, and it is pivotally supported between the side frames 10 about a pivot pin 3.

The front (left hand) portion of the hand lever 2 integrally extends forward from the pivot pin 3, thereby to form an operating lever 2A which is comprised of a printing portion 2*a* and an actuating portion 2*b*. A printing head 7 is mounted to the printing portion 2*a*. In the printing head, a plurality of type carrying wheels 8*a*, 8*b*, 8*c*, etc. are juxtaposed to one another such that they can be individually rotated. See, for example, U.S. Pat. No. 4,018,157 issued Apr. 19, 1977. The type carrying wheels 8*a*, 8*b*, 8*c*, etc. are made of a hard, i.e. non-deformable in normal use, plastic material. The outer peripheries of the type carrying wheels carry or are formed with sets of printing types 9*a*, 9*b*, 9*c*, etc., respectively.

A spring hook eye bracket 4 is mounted to the upper front (left hand) end of the hand lever 2. A spring hook pin 5 is mounted to the inside of the rear end portion of the hand grip 1. A compression type return spring 6 is hooked between the hook eye bracket 4 and the hook pin 5 so that the hand lever 2 may always be biased clockwise, apart from the grip 1, and be biased together with the actuating lever 2A.

Below the actuating portion 2*b* of the operating lever 2A, there is a feed roller 11, which is formed on its outer circumference with a plurality of equi-distantly spaced feed pins 12. The feed roller 11 is rotatably mounted upon a spindle 13, which is supported between the side frames 10 of the hand labeler. The feed roller 11 is turned counter-clockwise by a driven mechanism (not shown), when the hand lever 2 is released, i.e., when the operating lever 2A is returned upward or clockwise about the pivot pin 3, and this feeds a continuous strip 30 of labels, one at a time.

Figure 2:
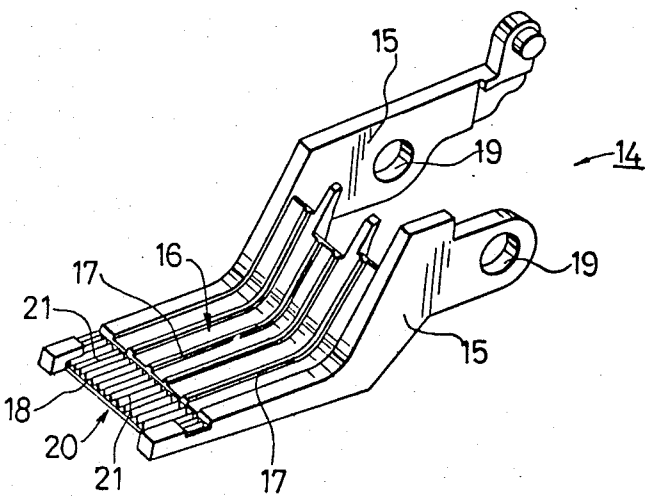
FIG. 2 is a perspective view showing the printing platen of FIG. 1.
Figure 4A:
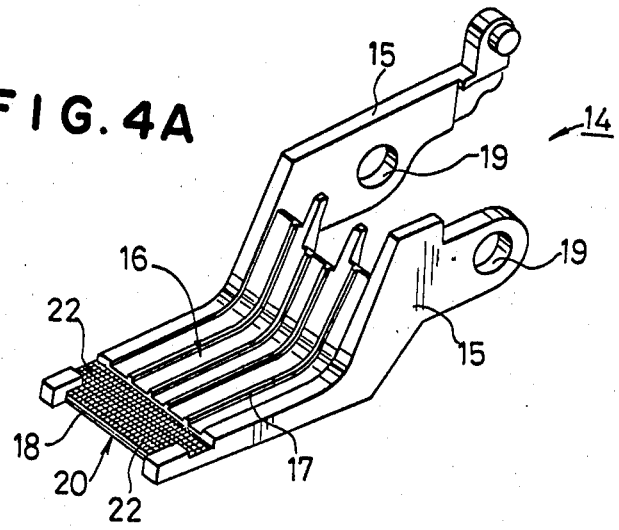
FIG. 4(A) is a view similar to FIG. 2, but showing another embodiment of platen according to the present invention.
Figure 4B:
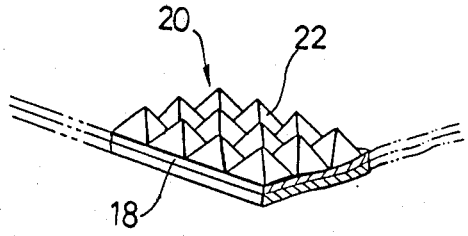
FIGS. 4(B) to 4(D) are enlarged perspective views showing other embodiments of platens according to the present invention.
Figure 4D:
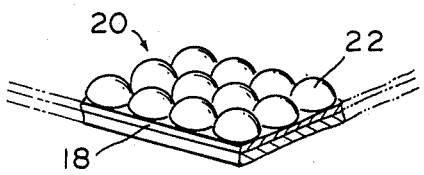
Figure 4C:
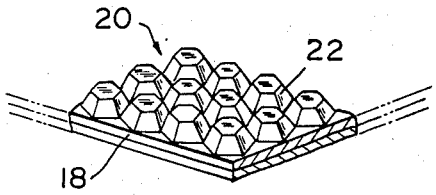

A printing platen 14 according to the present invention is disposed in front (to the left) of the feed roller 11. As shown in FIG. 2, the body of the printing platen 14 is made of a hard plastic material or of metal. The platen is comprised of a pair of upright side plates 15, each of which is respectively formed at its rear (right hand) portion with one of a pair of coaxial bores 19. The spindle 13 is fitted in the bores 19 of the side plates 15 of the platen so as to position the platen and also to rotatably support the feed roller 11 between the side plates 15.

The printing platen 14 includes a label guide bottom plate 16 having a bent shape, and the plate 16 is mounted between the platen side plates 15 at the front (left hand) portions thereof. The upper surface of the bottom plate 16 is formed with a plurality of rails 17 which extend parallel to the advancing direction of the continuous label strip 30.

The leading (left hand) end portion of the bottom plate 16 is formed with a shallow recess, in which an impression plate 18, made of an elastic material such as rubber or a soft plastic material is received to form a printing portion 20 of the platen. The impression plate 18 has an upper surface that is roughened, such that a multiplicity of corrugations 21 are formed, and these are oriented in the advancing direction of the continuous label strip 30. In other embodiments of the platen shown in FIGS. 4(A) to 4(D), on the other hand, the impression plate is formed with a multiplicity of narrow cross-section projections 22, which are arranged in a closely packed array, e.g. of a plurality of rows and columns. More specifically, the individual projections 22 may have any of square, pyramidal, hexagonal and/or semi-spherical cross-sectional shapes, as shown in FIGS. 4(A) to 4(D), respectively.

Figure 3:
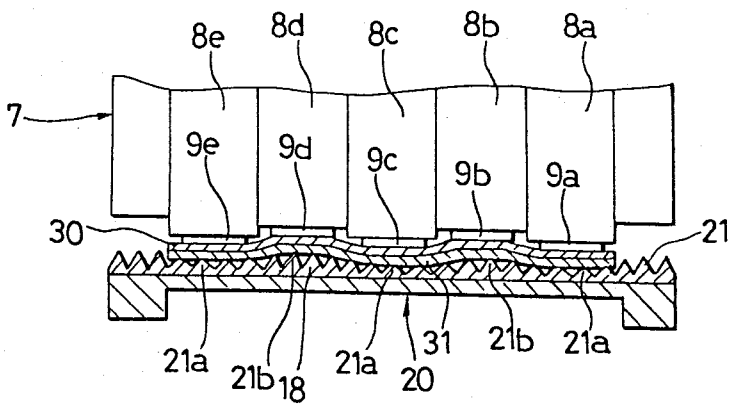
FIG. 3 is a cross-sectional front view showing the contacting condition between the printing platen and the printing head during the printing operation.

There is no limitation on the widths of the corrugations or on the cross-sectional dimensions of the projections 22. As shown in FIG. 3, however, the corrugations 21 are desirably sized so at least two, and preferably from two to four of them in the width direction across the platen and across the printing head has the width of one of the printing types 9*a*. Correspondingly, the projections 22 are so sized, shaped and spaced that, across the impression plate 18, every type 9*a*, etc. will contact at least two, and preferably from two to four, of the projections 22 in the direction across or the direction along the platen.

Turning to FIG. 1, a label holder 23 for a rolled label strip 29 feeds the unrolled label strip 30 to a label guide member 24 that directs the continuous label strip 30 past the feed roller 11 to the platen 14. There is a printing type inking assembly 25 having one end that carries an inking roller 26 and having another end that is supported rotatably on one of the side plates 10 by means of a pivot pin 27, so that the inking roller can roll across the types 9. A printed label applying roller 28 is mounted to the lower front end of the hand labeler.

The operation of the hand labeler with the platen according to the present invention is now described.

The label strip 30 is unrolled from the rolled label strip 29. The label strip 30 is guided by the lower side of the label guide member 24 and is then forced into contact with the outer circumference of the feed roller 11. Perforations (not shown) in the label strip are brought into engagement with the feed pins 12 of the feed roller 11. The label strip 30 is then advanced along and past the upper surface of the printing platen 14. Only the strip of backing paper 31 of the label strip is turned rearwardly at the space which is formed in front of the leading or forward end of the printing portion 20 of the platen. The backing paper 31 is then let out of the body of the hand labeler after it has again engaged the feed pins 12 at the lower circumferential portion of the feed roller 11. Meanwhile, the labels 32, which have been separated or peeled from the backing paper 31 in front of the printing portion 20, are fed below the label applying roller 28.

When the hand lever 2 is squeezed toward the hand grip 1 from its released condition shown in FIG. 1, the operating lever 2A is turned counter-clockwise about the pivot pin 3. This moves the printing head 3 down and the printing types 9*a*, 9*b*, 9*c*, etc. are then supplied with ink from the inking roller 26. Under the fully squeezed condition of the hand lever 2, the types 9*a*, 9*b*, 9*c*, etc. impress the portion of the label strip 30, which is then positioned on the impression plate 18 at the leading end of the printing platen 14, thus accomplishing the printing operation.

Consider a case in which the printing types 9*a*, 9*b*, 9*c*, etc. which are then at the printing or lowermost positions of the respective carrying wheels 8*a*, 8*b*, 8*c*, etc. are of such irregular height, tilt orientation, etc. that all the type surfaces are not flat or are not generally in a common plane or are not all uniformly pressing against or flat against the label strip. Such a condition is illustrated in FIG. 3. In this case, if the impression plate 18 were made of a hard material, such as a metal, according to the prior art, the relatively sunken or misoriented types fail to or cannot contact sufficiently with the label surface so that their imprint does not become clear or, still worse, their imprint is not obtained at all. According to the present invention, on the other hand, since the impression plate 18 is made of an elastic material and is also formed with corrugations or projections, the upraised ridges 21*a* that contact the raised types 9*a*, 9*c* and 9*e* are depressed, whereas the other upraised ridges 21*b* that contact the sunken types 9*b* and 9*d* are kept substantially free from deformation and retain their initial forms. As a result, the label strip 30 sandwiched between the types 9*a*, 9*b*, 9*c*, etc. and the impression plate 18 is curved across the width of the printing head to follow the curved imaginary surface joining the apexes of the ridges 21*a* and 21*b*. Thus, all of the printing types 9*a*, 9*b*, 9*c*, etc. can contact the upper side of the label strip 30 substantially uniformly across the label strip so that a clear imprint having a uniform averaged density can be effected, without any imprint missing and without any thinned imprints.

Of course the foregoing effects can also be obtained with types that are made of an elastic material, such as rubber, as is done in the prior art, but such types would still be beneficially used in conjunction with a platen according to the invention.

When the hand lever 2 is released from its squeezed condition, it is returned clockwise together with the operating lever 2A by the biasing action of the return spring 6. As a result, the printing head 7 is moved upward, and the drive mechanism (not shown) is actuated to turn the feed roller 11 a preset angle so that the label strip 30 is moved forward one pitch, or the length of one label, by the feed pins 12 of the roller 11. Since, in the meanwhile, the backing paper 31 is pulled backward by the feed pins 12, the printed label 32 is peeled from the backing paper 31 and is delivered below the label applying roller 28 so that it can be applied and adhered to a commodity.

During advancement of the label strip 30, since the label guide bottom plate 16 is formed on its upper side with the rails 17, the lower side of the label strip 30, i.e., the back paper 31, is allowed to contact only the upper sides of the rails 17 with such a low frictional resistance while the label strip 30 is advancing, that the label strip 30 can be conveyed smoothly.

As has been described hereinbefore, according to the present invention, the impression plate of the printing platen is made of the elastic member having corrugations or projections on the top thereof, i.e. the side contacting the label strip. As a result, even if the type surfaces of the printing head are irregular or rough, the corrugations or projections of the elastic impression plate are depressed by the corresponding protruding printing types so that the surfaces of all of the types are brought into proper contact with the label strip. Thus, a clear imprint having an averaged density can be effected, without any missing or thinned characters. It is another advantage that the shock of initial contact between the types and the platen during the printing operation is so damped that the printing head and platen can be prevented from being damaged.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A printing platen for use with a label printing machine, or the like, wherein said platen includes a surface thereof on which a strip of labels, or the like objects to be imprinted, is fed and wherein said platen surface is opposed to and is adapted to be moved against printing types supported by a printing head, or the like; said platen including a support frame; a plate shaped impression plate supported on said platen support frame; said impression plate having a surface thereof which is the said surface of said platen that is opposed to printing types; said impression plate having a plurality of projections projecting up from said impression plate surface; said impression plate projections being comprised of elastic and deformable material and being adapted to be depressed to varying extends upon being engaged by printing types and said projections are of such height and deformability that, when printing types are applied against the label strip and are pressed against said impression plate surface projections, the types of a printing head may elastically deform said projections to varying extents depending upon the extent of irregularities of the types, and the types may be imprinted upon labels with a uniform, averaged density, despite irregularities in the types or in the orientations of the types; said projections of said impression plate are in the form of a plurality of corrugations defined in said impression plate surface; said corrugations are oriented on said impression plate that each said corrugation extends parallel to the direction of advancing movement of the label strip over said impression plate; said corrugations are of such a width, are so sized and are so placed that at least two of said corrugations will be covered over in the width direction across said platen by each printing type when the type engages a label strip on said impression plate surface.

2. The printing platen of claim 1, further comprising a label guide bottom plate adjacent to said impression plate and positioned for being upstream in the path of advancing movement of the label strip past said platen, whereby the label strip first advances over said label guide bottom plate and thereafter over said impression plate.

3. The printing platen of claim 2, wherein said bottom plate has an upper surface thereof facing in the same direction as said impression plate surface and said bottom plate upper surface is formed with a plurality of rails thereon which extend parallel to the advancing direction of the label strip over said bottom plate and toward said impression plate.

4. A label printing machine comprising: a machine frame; said platen of claim 1, which is supported to said machine frame; an operating lever supported to said machine frame for moving with respect thereto; a printing head having a plurality of hard, non-deformable printing types thereon and being supported to said machine frame; said operating lever being connected with at least one of said printing head and said platen for moving said printing head and said platen together and apart, such that upon motion of said printing head to said platen, said types of said printing head are urged against said impression plate surface.

5. The label printing machine of claim 4, wherein said operating lever is attached to said printing head such that movement of said operating lever moves said printing head and it is said printing head that is the one of said printing head and said platen that moves to cause said printing head and said platen to move together and apart.

* * * * *